US006837651B1

(12) United States Patent
Basta

(10) Patent No.: US 6,837,651 B1
(45) Date of Patent: Jan. 4, 2005

(54) GRAVITY WATERCRAFT LIFT

(75) Inventor: Samuel T. Basta, Bellevue, WA (US)

(73) Assignee: IPO L.L.C., Bellevue, WA (US)

( * ) Notice: Subject to any disclaimer, the term of this patent is extended or adjusted under 35 U.S.C. 154(b) by 0 days.

(21) Appl. No.: 10/650,503

(22) Filed: Aug. 27, 2003

(51) Int. Cl.[7] ..... B63C 3/06
(52) U.S. Cl. ..... 405/3
(58) Field of Search ..... 405/1, 3, 4, 7

(56) References Cited

U.S. PATENT DOCUMENTS

| | | | | |
|---|---|---|---|---|
| 3,021,965 A | | 2/1962 | Harvey | |
| 4,895,479 A | | 1/1990 | Michaelsen et al. | |
| 5,184,914 A | | 2/1993 | Basta | |
| 5,275,505 A | | 1/1994 | Wilcox | |
| 5,888,019 A | * | 3/1999 | Quastad | 405/3 |
| 5,890,835 A | | 4/1999 | Basta et al. | |
| 5,908,264 A | | 6/1999 | Hey | |
| 5,919,000 A | | 7/1999 | Unkle | |
| 6,318,929 B1 | | 11/2001 | Basta | |
| 6,612,775 B1 | | 9/2003 | Hewitt | |

* cited by examiner

*Primary Examiner*—Frederick L. Lagman
(74) *Attorney, Agent, or Firm*—Anthony Claiborne

(57) ABSTRACT

In a lift for watercraft, a load translation mechanism balances load upon the actuator throughout the raising and lowering of watercraft, thereby greatly reducing load spikes. Embodiments of the improved lift employing an over-center locking mechanism further employ an elastic stop means to reduce jarring of the apparatus when it locks in the over-center position. In some preferred embodiments, adjustable telescoping booms allow the user to adjust the height of the lifted watercraft above the base of the lift.

8 Claims, 5 Drawing Sheets

GRAVITY WATERCRAFT LIFT

BACKGROUND OF THE INVENTION

1. Field of the Invention

This invention relates to lifting devices, specifically to improvements in such devices that are employed to lift watercraft, for example boats and seaplanes.

2. Description of the Related Art

Users of watercraft have need to lift their watercraft from the water, for example for maintenance or in preparation for land transportation of the watercraft. Equally, watercraft users have need to lower their watercraft into the water, for example for launching or simply for flotation at dock. Users have heretofore employed a number of devices for such lifting and lowering.

Typical of many such devices, U.S. Pat. No. 4,895,479, issued to Michaelsen et al., specifies a lift for watercraft having raised and lowered positions, comprising a substantially horizontal rectangular base for submersion in the water. In its preferred embodiment, the base, having a front, a back and two sides, is fixed and two pair of upwardly extending booms are each pivotally connected at their lower end to the base at its corners. The members of each pair of booms are rigidly connected to each other in parallel by cross supports. Two substantially horizontal arms are each pivotally connected to one member of each pair of booms at the upper end of the boom, so that each arm pivotally connects to one member of one pair of booms at one end of the arm and to one member of the other pair of booms at the other end of the arm. Two connected, collapsible parallelograms are thereby formed, one on each side of the base, the corners of each parallelogram comprising the upper and lower pivot points of the front and rear booms on one side of the base. The pivotally connected arms lie in a plane, which is lowered as the parallelograms are collapsed and is raised when the parallelograms are expanded. A watercraft supported by support means connected to the arms in that plane may thereby be lowered and raised as the parallelograms are respectively collapsed and expanded.

In order to raise the watercraft in Michaelsen, as in most such devices, the parallelogram is forceably expanded by employment of an expanding actuator, typically a hydraulic cylinder. In Michaelsen, the base end of a hydraulic jack cylinder is connected centrally to a horizontal coplanar cross member of the frame disposed intermediate of the points of connection of the pairs of pivoting booms. The plunger of the jack is connected to a cross shaft journaled in brackets intermediate of the ends of that pair of pivoting booms that normally (in the lowered position) forms an obtuse angle in the parallelogram, thereby achieving a large angular swing of the lift arms for a given travel of the jack's plunger. Significantly, because raising the lift requires a vertical force component at all times, this actuator arrangement limits the extent to which this lift may be lowered, because, even at the lift's lowest level, a vertical component is required between the base of the jack and the distal end of its plunger in order for the expansion of the jack to have the effect of raising the lift.

In such devices, when the actuator has caused the watercraft to be raised to the desired position, a locking means is employed to maintain the craft in the raised position. In Michaelsen, locking is provided by a pawl mounted on the jack cylinder adjacent to its projecting plunger, the pawl having a nose fittable in spaced slots of the plunger and biased into the slots so that it automatically locks the lift in subsequent raised positions.

In U.S. Pat. No. 3,021,965 to Harvey, locking is provided by a locking and bracing assembly, comprising a rod or brace pivotally connected to a side of the base intermediate of the pivotal connection points of two collaterally corresponding members of the pairs of booms. The locking and bracing assembly further comprises a means for the rod lockably to engage that member which is over-center when the device is in the raised position, restraining that member against the force of gravity, thereby maintaining the device in the raised position.

U.S. Pat. No. 5,275,505 to Wilcox describes a locking mechanism having a clamping ring which is sleeved on the piston rod and is biased into locking position by a compression spring engaging a piston in a locking cylinder. The locking cylinder is selectively supplied with pressurized water to compress the spring and thereby release the clamping ring. These and other methods of locking a piston driven system against a force, well-known to practitioners in this and analogous arts, are widely employed in watercraft lift design.

U.S. Pat. No. 5,184,914, issued to the inventor of the present invention and which is incorporated herein by reference, takes a different approach to locking. The inventions heretofore described provide locking by restraining, by various methods, the collapse of partially expanded parallelograms. In '914, in contrast, the actuator expands the parallelogram over-center, so that initially obtuse angles of the parallelogram become acute and initially acute angles become obtuse. In the over-center raised position, preferably one to ten degrees from vertical, a locking means is provided by rigid canted boom stops affixed to the base to engage downward-tending booms, thereby providing locking of the lift in a raised, over-center position. To lower the lift from the over-center position, '914 requires that the actuator be double-acting, providing expanding actuation for raising, as in the prior art, but also providing contracting actuation for moving the lift back over center for lowering, as provided preferably by a double-acting hydraulic cylinder. '914 teaches connection of the actuator between a cross member of the frame and a cross member of a pair of booms intermediate of the ends of the booms, just as in Michaelsen, limiting the extent to which the lift may be lowered.

Based upon the innovation of '914, U.S. Pat. No. 5,908,264 to Hey teaches a similar over-center boat lift with a locking means for the over-center raised position comprising a rigid canted diagonal member, affixed to the base, that braces against the boom in its over-center position. Hey claims to improve upon '914 in achieving a lower profile by employing a different actuator arrangement. In Hey, the frame extends beyond the point of connection of that boom pair which, in the lowered position, forms an obtuse angle in the parallelogram. The base of the actuator is pivotally connected to a transverse beam disposed on that extended portion of the frame. The transverse beam is so formed that the point of connection of the base of the actuator is lower than the plane of the frame. By this design, even when the parallelogram is fully collapsed, there is a vertical component between the cylinder base and the distal end of the plunger, thereby enabling lift operation from a lower profile in the fully lowered position.

Hey's actuator arrangement, while permitting a lower profile watercraft lift, does not overcome a shortcoming of all the prior art. In all the prior art, including Hey, there is a load spike on the actuator at the lower end of the lift position. In Michaelsen and in '914, this load spike is very pronounced because the vertical component between the actuator base and its distal end is small at the lift's lowered position. Even in Hey, though, the vertical component is smaller at the lift's lowered position than it is as the lift is raised, resulting in a load spike on the actuator from the lowered position. Typically, the load on such prior art actuator arrangements spikes from up to 2,800 pounds per square inch from the lowered position down to about 1,700 pounds per square inch as the lift approaches its raised position.

The highest load on an actuator determines the actuator cylinder diameter, the maximum fluid pressure and the resultant actuator mechanism tolerances necessitated by such pressure. Lowering the maximum load on an actuator has the desirable effects of lowering the size of required actuator cylinder and reducing the tolerances required for actuator operation.

Despite their advantageous use of gravity to stop the lift in a raised position, prior art over-center watercraft lifts, such '914 and Hey, teach a stop means with a significant shortcoming. Such prior art stop means employ a fixed stop of hard, rigid material directly or indirectly engaging the pivoting booms when the lift has reached the desired over-center position. The resultant engagement is jarring because the stop mechanism materials are inelastic. Such jarring engagement is undesirable not only because it creates a less than optimal user experience, but also because jarring subjects the lift apparatus to excessive stain with resultant fatigue, shortening equipment life.

Yet a further shortcoming of the over-center prior art arises from the fact that the stop mechanism in such art restrains the raised, over-center lift with the watercraft support at a fixed height above the lift base. However, a user may have any of a number of reasons for wishing to vary the height of the lift's watercraft support. For example, because of variations over time in the depth of the body of water in which a given lift is employed (e g. ocean tides, annual variations in lake depth, etc.), with the prior art over-center lifts, the height of the raised watercraft above the water's surface may vary considerably, according to variations over time in the depth of the water. A user may wish to vary the height of the watercraft support of the raised lift above the lift's base to accommodate varying water depths. In other cases, a user may wish to vary the height of the lift's watercraft support above the surface of the water for specific watercraft maintenance or transportation purposes. In any case, it is a shortcoming that the prior art presents no means whereby a user can vary the height of the watercraft support of a raised over-center lift.

OBJECTS AND ADVANTAGES

It is an object of this invention to provide an improved over-center watercraft lift obviating load spikes on the lift actuator.

It is a further object of this invention to provide such an improved watercraft lift that also presents a low profile when in its lowered position.

It is a further object of this invention to provide an improved watercraft lift that embodies the advantages of the over-center locking mechanism while also minimizing jarring engagement of the apparatus.

It is a further object of this invention to provide an over-center watercraft lift wherein the height of the lift's watercraft support in the locked, raised, over-center position is adjustable.

These and other objects of the invention will be apparent to those skilled in this art from the following detailed description of a preferred embodiment of the invention.

BRIEF DESCRIPTION OF THE INVENTION

The present invention improves upon prior art watercraft lifts by coupling the lift actuator to the lift apparatus via a load translation mechanism advantageously fashioned to obviate or at least minimize load spikes upon the lift actuator throughout the lifting and lowering duty cycle of the apparatus. Preferred embodiments of the present invention practice the prior art of over-center lifting, advantageously incorporating a novel elastic stop mechanism to minimize jarring upon stopping in the raised, over-center position. Over-center embodiments of the present invention may incorporate a means of adjusting the height assumed by a watercraft from the lift base when the lift is in the locked, raised, over-center position.

BRIEF DESCRIPTION OF THE DRAWINGS

The foregoing objects, as well as further objects, advantages, features and characteristics of the present invention, in addition to methods of operation, function of related elements of structure, and the combination of parts and economies of manufacture, will become apparent upon consideration of the following description and claims with reference to the accompanying drawings, all of which form a part of this specification, wherein like reference numerals designate corresponding parts in the various figures, and wherein:

DETAILED DESCRIPTION OF THE PREFERRED EMBODIMENTS

Figure 1:
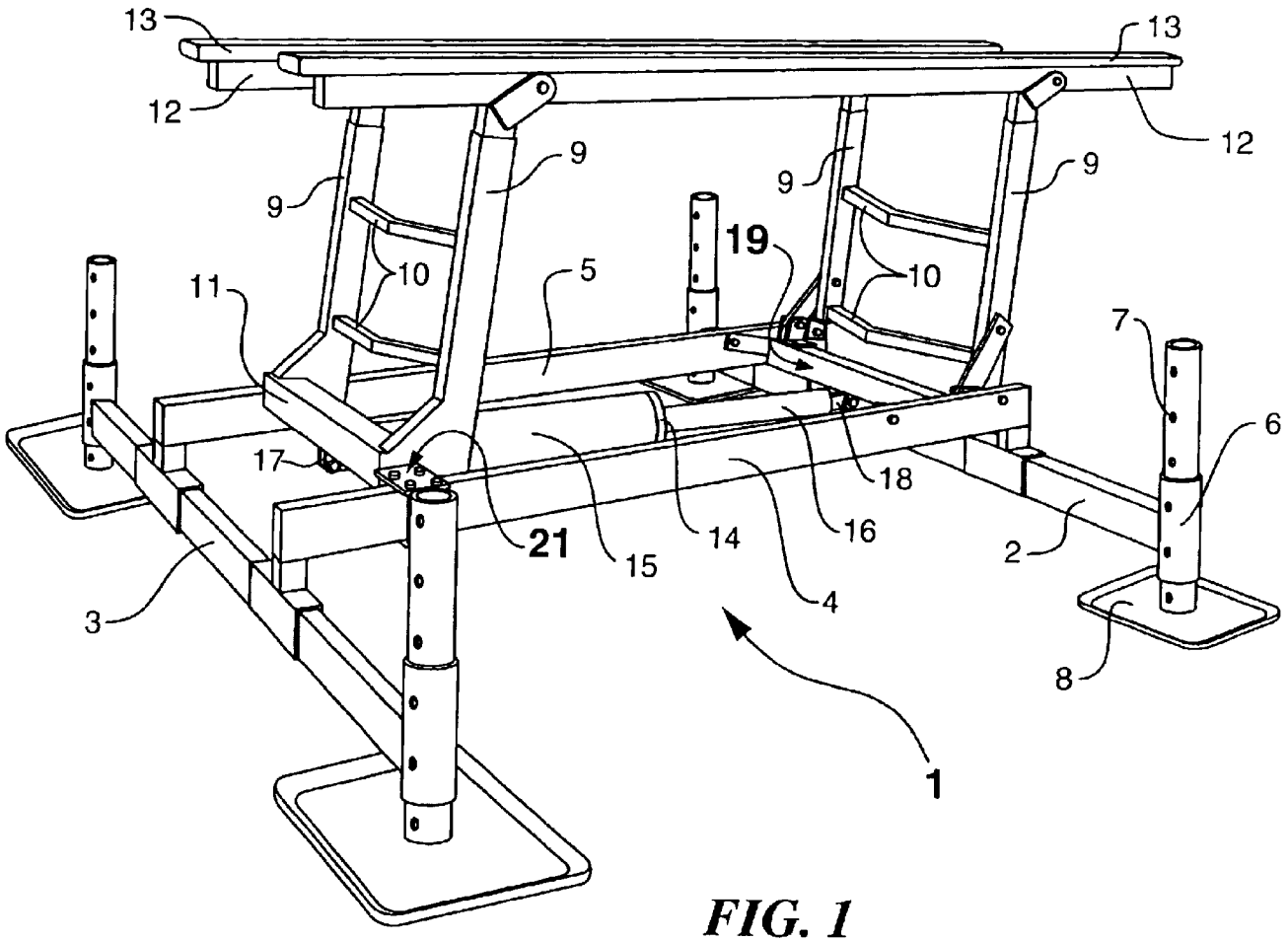
FIG. 1 is a front side perspective view of a gravity watercraft lift in the raised, over-center position, according to the present invention.
Figure 2:
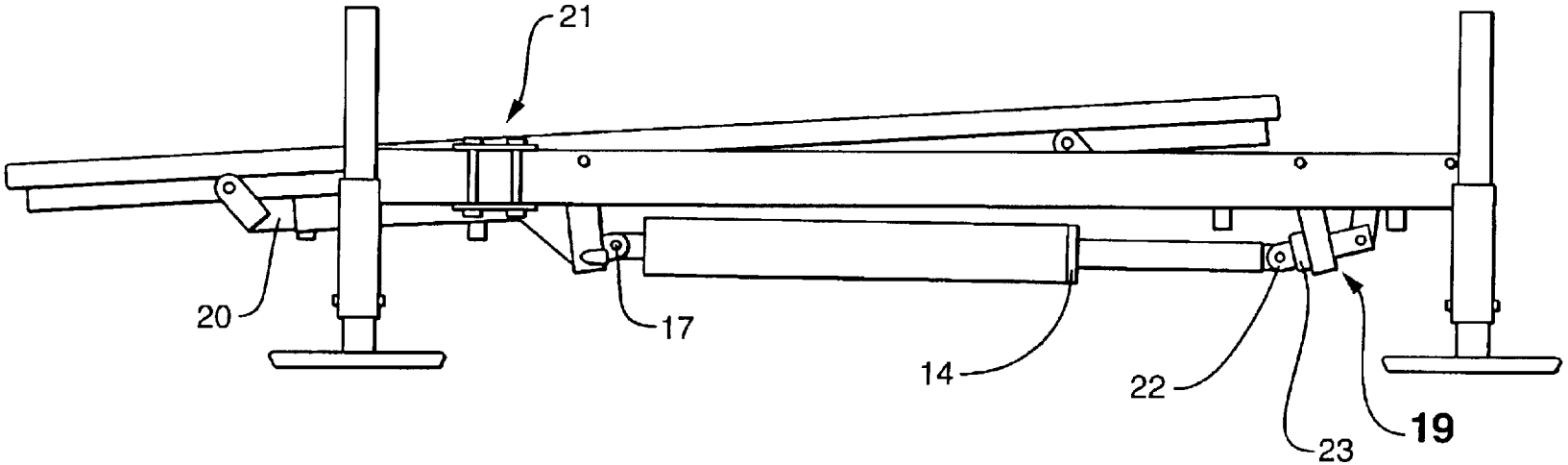
FIG. 2 is an elevational view of a gravity watercraft lift in the lowered position, according to the present invention.

Referring to FIGS. 1 and 2, the watercraft lift of the present invention has a rectangular base 1 which includes front transverse beam 2 and rear transverse beam 3 which are connected to longitudinal parallel beams 4 and 5. Each of front transverse beam 2 and rear transverse beam 3 have sleeves 6 receiving support posts 7 that are of adjustable height to position the rectangular base 1 at a desired depth submerged in the water. Support posts 7 have shoes 8 which rest on the river or lake bed.

Four pivoting booms 9 are attached to rectangular base 1, one for each of the four corners of rectangular base 1, with the lower ends of front booms 9 pivotally joined to the base adjacent the front ends of each of longitudinal parallel beams 4 and 5 and the lower ends of rear booms 9 proximal the rear ends of beams 4 and 5, on the beam's interior faces. Intermediate cross supports 10 provide structural integrity of the front and rear pairs of pivoting booms 9. At the upper ends of pivoting booms 9, two mounting arms 12 are pivotally joined to swing with the booms 9, as a collapsing parallelogram, maintaining parallelism with longitudinal parallel beams 4 and 5. Watercraft supports 13 attached to mounting arms 12 brace the watercraft during lifting.

A double-acting hydraulic cylinder 14 having a piston jacket 15 and a piston rod 16 is mounted within the lift. In the preferred embodiment, the end of piston jacket 15 distal the piston rod is pivotally connected to actuator brace 11 via a bracket 17 integral to brace 11 that serves as an extension of rear boom 9 past the axis of its pivot point on beams 4 and 5. Alternative embodiments may pivotally connect the end of piston jacket 15 either to base 1, or to a cross-piece (not illustrated) between beams 4 and 5 along the axis of the pivot point of rear boom 9 upon the beams. In any case, in embodiments of the present invention the end 18 of piston rod 16 distal the piston jacket is pivotally coupled via load translation mechanism 19 to front pivoting booms 9 adjacent the pivot point of booms 9 upon longitudinal parallel beams 4 and 5. Advantageously, the pivotal connection points of piston jacket end 17 and piston rod end 18 to the lift apparatus are disposed so that, when the lift is in the lowered position, the level of cylinder 14 is below the plane formed by the upper side of base 1, thereby allowing low profile lift positions while the underside of a watercraft remains clear of the cylinder. Lowering and raising of mounting arms 12 and watercraft supports 13 is achieved by extension and retraction of piston rod 16 of double-acting hydraulic cylinder 14.

As cylinder 14 is extended when the lift is in a lowered position (FIG. 2), the force exerted by cylinder 14 between actuator brace 11 and load translation mechanism 19 is translated via load mechanism 19 to yield a rotational force component acting upon forward booms 9 about their pivot point, causing the lift to rise. Load translation mechanism 19 is described in more detail with reference to FIG. 3 below. While those in the art will recognize that the present invention is not limited to over-center lifts, in the preferred embodiment the full extension of cylinder 14 results in booms 9 swinging over center by about one to ten degrees (FIG. 1).

Although the preferred embodiment as described teaches an actuator cylinder 14 with a piston rod 16 pivotally engaged with load translation mechanism 19, it will be recognized by those in the art that the scope of the present invention extends to other embodiments wherein an expanding actuator is coupled via load translation mechanism 19 to front pivoting booms 9 to exert a force as described above. For example, within the scope of the present invention, in other embodiments (not illustrated) the piston rod 16 may be pivotally coupled to actuator brace 11 and the base of piston jacket 15 may be pivotally coupled to load mechanism 19. Yet other embodiments within the scope may pivotally couple one end of the actuator to the rectangular base 1 while coupling the other end of the actuator to a load translation mechanism as taught by the present invention.

In the preferred embodiment, rear booms 9 swing to the over-center position and are restrained from further downward travel by stop means embodied as boom stops 21 affixed to rear booms 9, described in more detail in reference to FIG. 4 below. Advantageously over the prior art, boom stops 21 employ an elastic material, thereby greatly reducing jarring when the over-center apparatus is restrained by boom stops 21.

The length of booms 9 is adjustable via boom height adjustment mechanism 20. Illustrated here and in more detail in reference to FIG. 5 below, a preferred embodiment employs telescoping sections in boom 9 restrained at a desired height by retaining pin. A typical over-center watercraft lift raises watercraft supports 13 to a height approximately 48 inches above base 1. Advantageously, by employing boom adjustment mechanism 20 to vary the length of booms 9, the user may vary the height of the raised lift above its base, preferably from 36 inches or less to more than 60 inches.

Figure 3:
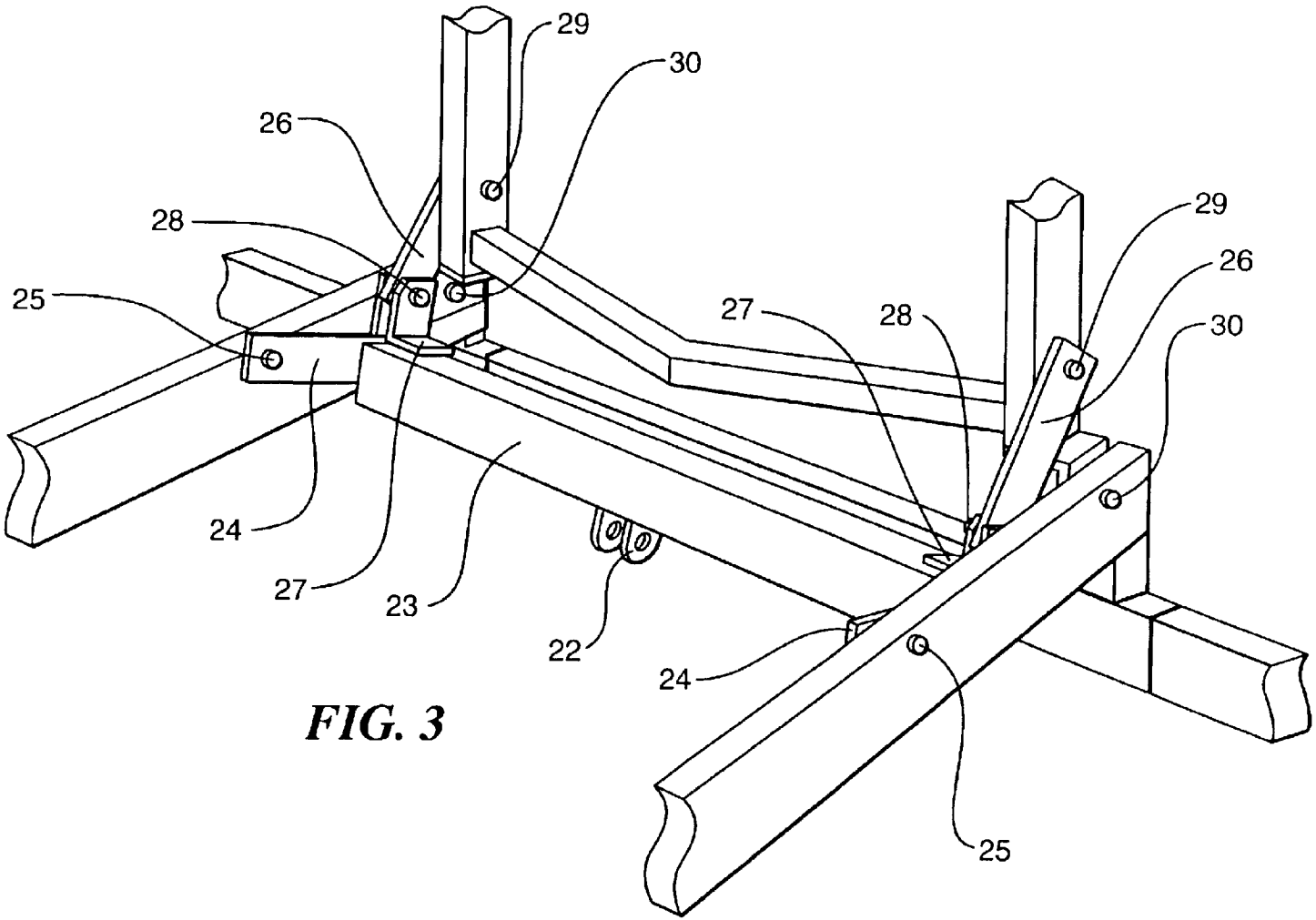
FIG. 3 is a detailed perspective detail of the load translation mechanism in a preferred embodiment of the present invention.

Turning now to FIG. 3, load translation mechanism 19 is shown wherein piston rod 16 of hydraulic cylinder 14 is pivotally mounted to mechanism 19 via support brackets 22 affixed to swing bar 23. Swing bar 23 is swingably mounted to parallel beams 4 and 5 by integral brackets 24 that are rotatably mounted to beams 4 and 5 via rotation bolts 25. Swing bar 23 is swingably coupled to front booms 9 via lift bars 26, each having two ends, one of which is rotatably mounted to swing bar 23 at support bracket 27 via rotation bolt 28, the other of which is rotatably mounted to front boom 9 via rotation bolt 29. Front boom 9 is, in turn, pivotally coupled to beams 4 and 5 by rotation bolt 30.

When the lift is in its lowered position, swing bar 23 hangs down from beams 4 and 5 by integral brackets 24, approximately perpendicularly to beams 4 and 5. In operation, as hydraulic cylinder 14 is expanded, the force exerted between rear transverse beam 3 (FIGS. 1 and 2) and swing bar 23 results in rotation of integral brackets 24 about rotation bolts 25, causing swing bar 23 to swing with force in a forward and upward direction. The forward and upward swing of swing bar 23 is translated into an upward force by its action upon lift bars 25, causing booms 9 to pivot upward about rotation bolt 30. This swingable mounting and coupling arrangement for swing bar 23 with respect to lift base 1 via beams 4 and 5 and with respect to forward booms 9 via lift bars 26 has the effect of balancing the upward component of force exerted by load translation mechanism 19 approximately to match the varying load at front booms 9 as the lift is raised and lowered, thereby largely obviating load spikes in the operation of the lift.

While the foregoing description of load translation mechanism 19 specifies a preferred embodiment, other embodiments employing other means of balancing the load upon actuator 14, and thereby obviating load spikes, are contemplated. It is observed that, when the booms 9 are at a given angle $\theta$ with respect to beams 4 and 5, the vertical force that must be applied to increase angle $\theta$ by a fixed amount varies in proportion to cosine $\theta$. Any load translation mechanism capable of translating a constant force by the actuator to an angular force varying approximately with cosine $\theta$ will have the effect of balancing the load upon the actuator. In addition to the preferred embodiment described above, such a result may be achieved by apparatus employing, for example, appropriately designed off-center cam arrangements and such other mechanisms as are known by persons of skill in the art to achieve the load balancing effect.

Figure 4:
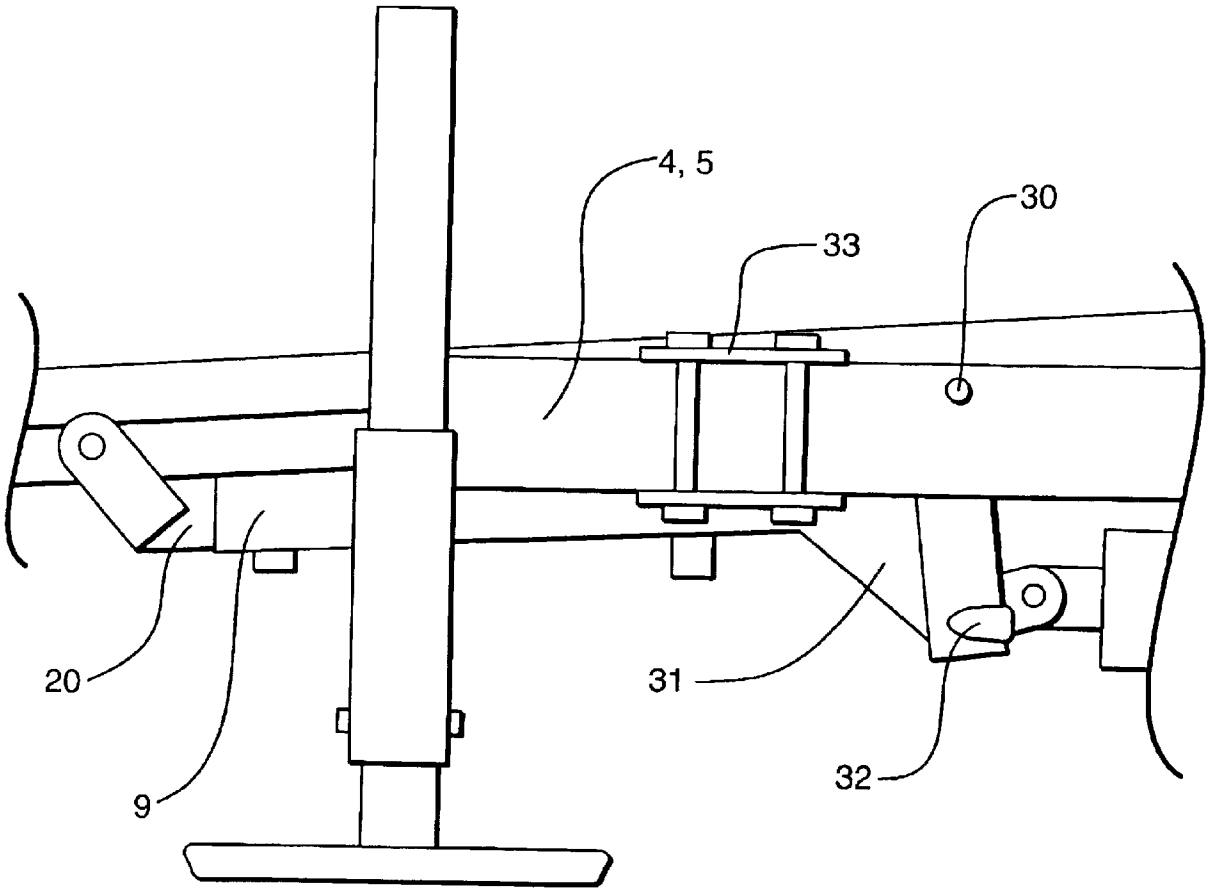
FIG. 4 is a side elevational detail of a non-jarring stop means in a preferred embodiment of the present invention.

Turning now to FIG. 4, illustrated is a detail of the lift in the lowered position depicting an embodiment of boom stop 21. Rear booms 9 are pivotally connected to longitudinal beams 4, 5 by rotation bolt 30. Integral to boom 9 at its lower end is delta bracket 31 which rotates about bolt 30 as boom 9 is lowered and raised. At the end of delta bracket 31 distal bolt 30 is elastic stop 32 affixed to bracket 31 by metal bolt (not shown). Elastic stop 32 advantageously is comprised of an elastic material such as latex or neoprene rubber.

In this embodiment, stop bracket 33 is affixed to each of longitudinal beams 4 and 5 on the rear side of such beam from rotation bolt 30. Stop bracket 33 comprises a substantially horizontal upper plate on beam 4, 5 with a substantially overhanging portion oriented toward the interior of base 1. In this embodiment, the upper plate of bracket 33 overhangs beams 4, 5 by more than one inch.

As rear booms 9 are raised to the over-center position, delta brackets 31 rotate about rotation bolt 30, lifting elastic stop 32 to engage opposing stop bracket 33 affixed to beams 4, 5 thereby restraining the lift in the raised, over-center position.

As will be recognized by those of skill in the art, stop bracket 33 is not limited to the foregoing embodiment but may instead be implemented as any surface firmly affixed to beams 4, 5 (by welding, bracketing, bolting and other methods known to those in the art) directly or indirectly, permitting raising and lowering of the apparatus in its normal operation, and engaging and opposing an elastic stop 32 or its equivalent when the lift is in its over-center, raised position. Alternatively, in the spirit of the present invention, stop bracket 33 may be fixed in relation to pivoting booms 9 and elastic stop 32 or its equivalent may be firmly affixed to beams 4, 5.

Figure 5:
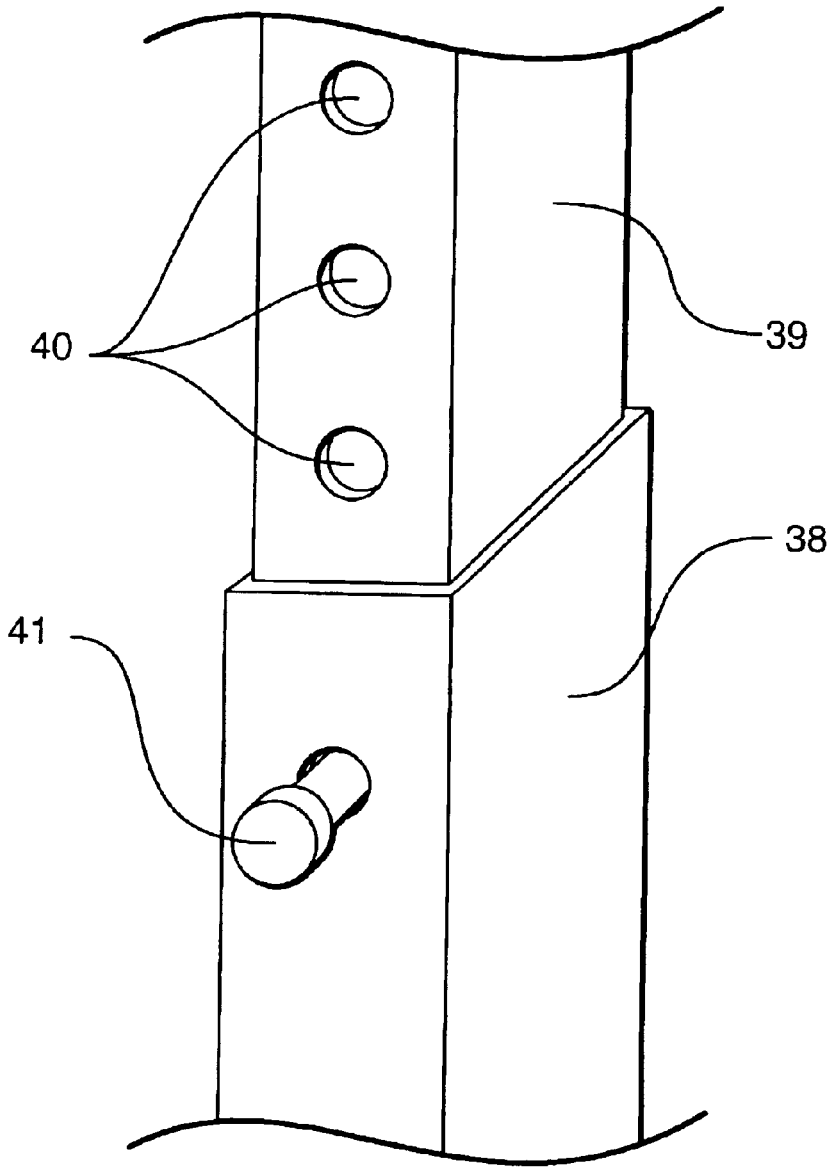
FIG. 5 is a view of a telescoping means of adjusting boom height in a preferred embodiment of the present invention.

Turning now to FIG. 5, illustrated is a detail of the lift in its raised position, showing boom adjustment mechanism 20 on a single boom 9. In this embodiment, booms 9 are telescoping, each comprised of a lower, exterior portion 38 within which is telescopically mounted an upper, interior portion 39. Drilled through interior portion 39 at fixed points along its length are restraining holes 40. Drilled through exterior portion 38 at a point proximate its upper end is a restraining hole through which is inserted restraining pin 41 for engagement with interior portion 39 at one of its restraining holes 40. In operation, the user selects a given height for the lift determined by one of the restraining holes 40 and will adjust each of the lift's four booms 9 so that the desired restraining hole 40 in the interior portions 39 is engaged by the restraining pins 41. In some preferred embodiments, engagement with a central hole 40 results in a height of watercraft supports 13 above base 1 of approximately 48 inches, while engagement with the extreme holes 40 results in a height of supports 13 above base 1 varying from 30 inches or less to more than 60 inches respectively. As will be recognized by those of skill in the art, boom adjustment mechanism 20 is not limited to the foregoing embodiment but may instead be implemented as any lockably adjustable telescoping arrangement, including those employing crimp bolts, locking clamps, toothed cogs and equivalents known to those in the art.

Conclusions, Ramifications, and Scope

Accordingly, it can be seen that the invention described herein provides an improved watercraft lift wherein the load on the actuator is balanced during operation of the lift. The improved lift further may be fashioned so that it presents a low profile when in its lowered position. Further, embodiments of the present invention improve upon over-center lift design by employing an elastic material in its over-center locking mechanism that minimizes jarring engagement of the apparatus. Yet further, the present invention provides an over-center watercraft lift wherein the height of the lift's watercraft support in the locked, raised, over-center position is adjustable.

Although the detailed descriptions above contain many specifics, these should not be construed as limiting the scope of the invention but as merely providing illustrations of some of the presently preferred embodiments of this invention. Various other embodiments and ramifications are possible within its scope, a number of which are discussed in general terms above.

While the invention has been described with a certain degree of particularity, it should be recognized that elements thereof may be altered by persons skilled in the art without departing from the spirit and scope of the invention. Accordingly, the present invention is not intended to be limited to the specific forms set forth herein, but on the contrary, it is intended to cover such alternatives, modifications and equivalents as can be reasonably included within the scope of the invention. The invention is limited only by the following claims and their equivalents.

I claim:

1. A watercraft lift apparatus, comprising:

a base;

a first pair of booms having a first pair of ends pivotally joined to said base to rotate about a first axis and a boom extension projecting from said first pair of ends thereof;

a second pair of booms having a first pair of ends pivotally joined to said base to rotate about a second axis;

watercraft supports pivotally connected to said pairs of booms;

an actuator having a first end and a second end, the first end of which is pivotally connected to said boom extension to rotate about a third axis that is offset from the first axis; and a load translation means, connected to said second pair of booms and pivotally connected to said actuator at its second end, for translating extension and contraction of the actuator to load balanced angular force acting on said second pair of booms about the second axis.

2. A watercraft lift apparatus according to claim 1, wherein said load translation means comprises a component swingably coupled to said base.

3. A watercraft lift apparatus according to claim 1, further comprising:

a stop means for elastically stopping the lift at a fixed position.

4. A watercraft lift apparatus according to claim 3, wherein said fixed position is over-center.

5. A watercraft lift apparatus according to claim 3, wherein said stop means comprises a surface and an elastic stop, the stop at least partially comprised of an elastic material, one of said surface and said stop affixed to at least one pair of booms and the other of said surface and said stop affixed to the base.

6. A watercraft lift apparatus according to claim 1, further comprising:

a means for adjusting the length of said pairs of booms thereby adjusting the height of said watercraft supports above the base when the lift is in a raised position.

7. A watercraft lift apparatus according to claim 6, wherein said means for adjusting the length of the booms is telescopic.

8. A watercraft lift apparatus, comprising:

a base;

a first pair of booms having a first pair of ends pivotally joined to said base to rotate about a first axis;

a second pair of booms having a first pair of ends pivotally joined to said base to rotate about a second axis;

watercraft supports pivotally connected to said pairs of booms;

an actuator having a first end and a second end, the first end of which is pivotally connected to said base; and a load translation means pivotally connected to said actuator at its second end, the load translation means comprising:

a swing bar, swingably mounted on said base;

and at least one lift bar swingably coupling said swing bar to one of said first and second pair of booms, whereby expansion and contraction of the actuator causes the swing bar to swing upon the base, displacing the at least one lift bar, thereby causing the booms to pivot upon the base, raising and lowering the lift.

* * * * *